US008042600B2

(12) United States Patent
Nakajima

(10) Patent No.: US 8,042,600 B2
(45) Date of Patent: Oct. 25, 2011

(54) APPARATUS FOR PRODUCING ALLOY

(75) Inventor: Kenichiro Nakajima, Chichibu (JP)

(73) Assignee: Showa Denko K.K., Tokyo (JP)

( * ) Notice: Subject to any disclaimer, the term of this patent is extended or adjusted under 35 U.S.C. 154(b) by 0 days.

(21) Appl. No.: 12/678,218

(22) PCT Filed: Sep. 18, 2008

(86) PCT No.: PCT/JP2008/066827

§ 371 (c)(1),
(2), (4) Date: Mar. 15, 2010

(87) PCT Pub. No.: WO2009/041338

PCT Pub. Date: Apr. 2, 2009

(65) Prior Publication Data

US 2010/0202917 A1 Aug. 12, 2010

(30) Foreign Application Priority Data

Sep. 25, 2007 (JP) ..... 2007-247851

(51) Int. Cl.
*B22D 11/12* (2006.01)
*B22D 45/00* (2006.01)

(52) U.S. Cl. ..... 164/269; 164/423

(58) Field of Classification Search ..... 164/269, 164/412, 423, 463
See application file for complete search history.

(56) References Cited

U.S. PATENT DOCUMENTS

| | | | | |
|---|---|---|---|---|
| 5,674,327 | A | 10/1997 | Yamamoto et al. | |
| 6,043,424 | A | 3/2000 | Horio et al. | |
| 7,442,262 | B2 | 10/2008 | Sasaki | |
| 7,958,929 | B2 * | 6/2011 | Hasegawa et al. | 164/269 |
| 2009/0095938 | A1 * | 4/2009 | Hasegawa et al. | 252/62.55 |

FOREIGN PATENT DOCUMENTS

| | | | | |
|---|---|---|---|---|
| EP | 1 749 599 | A1 | | 2/2007 |
| JP | 63-47301 | A | * | 2/1988 |
| JP | 63-047301 | A | | 2/1988 |
| JP | 05-222488 | A | | 8/1993 |
| JP | 9-155507 | | * | 6/1997 |
| JP | 9-155507 | A | * | 6/1997 |
| JP | 2000-225460 | A | | 8/2000 |
| JP | 2001-250990 | A | | 9/2001 |
| JP | 2002-266006 | A | | 9/2002 |
| JP | 2003-013116 | A | | 1/2003 |
| JP | 2003-188006 | A | | 7/2003 |
| JP | 2007-064490 | A | | 3/2007 |
| WO | 02/072900 | A2 | | 9/2002 |
| WO | 2005/105343 | A1 | | 11/2005 |
| WO | WO 2005/105343 | A1 | * | 11/2005 |
| WO | WO 2007/117037 | A1 | * | 10/2007 |

* cited by examiner

*Primary Examiner* — Kevin P Kerns
(74) *Attorney, Agent, or Firm* — Sughrue Mion, PLLC

(57) ABSTRACT

A production apparatus is provided which can produce an alloy which can produce a rare-earth magnet having high coercive force. The apparatus for producing an alloy is a device that includes at least a casting device for casting a molten alloy by a strip casting method, a crushing device for crushing cast alloy after casting, a heat-retaining device for maintaining temperature of cast alloy flakes N supplied from the crushing device, and a storage container for storing the cast alloy flakes N after maintaining the temperature. The heat-retaining device includes a heat-retaining container for storing the cast alloy flakes N supplied from the crushing device, a temperature retaining heater for maintaining the temperature of the cast alloy flakes N in the heat-retaining container, an inclination device for sending the cast alloy flakes N in the heat-retaining container to the storage container by inclining the heat-retaining container.

15 Claims, 2 Drawing Sheets

APPARATUS FOR PRODUCING ALLOY

FIELD OF THE INVENTION

The present invention relates to an apparatus for producing an alloy. In particular, the present invention relates to an apparatus for producing a R-T-B-based rare-element containing alloy (R is at least one element of the rare-earth elements containing Y, T is metal which contains essentially Fe, and B is boron).

Priority is claimed on Japanese Patent Application, No. 2007-247851, filed on Sep. 25, 2007, the contents of which are incorporated herein by reference in their entirety.

BACKGROUND OF THE INVENTION

R-T-B-based magnets, which have the maximum magnetic energy product in permanent magnets, are used for HD (hard disks), MRI (magnetic resonance imaging methods), various motors, etc. because they have high characteristics. In recent years, since saving energy has been increasingly demanded, in addition to an improvement of heat resistance of the R-T-B-based magnets, the use of R-T-B magnets as motors including a motor for vehicles has increased.

Since the main components of the R-T-B-based magnets are Nd, Fe, and B, the R-T-B magnets are also collectively called Nd—Fe—B magnets.

In the R-T-B magnets, R means Nd, a part of which is replaced with at least one rare-earth element, such as Pr, Dy, and Tb, in particular, often Nd, a part of which is replaced with at least one of rare-earth elements including Y. T means an alloy of Fe as an essential component, and Co, Ni, etc. B is boron, and may be partially substituted with C or N.

Other elements such as Cu, Al, Ti, V, Cr, Ga, Mn, Nb, Ta, Mo, W, Ca, Sn, Zr, and Hf may be added to the R-T-B-based alloys, singly or in combination of two or more species.

R-T-B-based alloys, which are R-T-B magnets, contain a ferromagnetic phase, $R_2T_{14}B$ crystals, which contribute to magnetization, as the main phase, and a nonmagnetic R-rich phase having a low melting point and containing a non-magnetic rare-earth element at high concentration.

Since the R-T-B-based alloy is an active metallic material, the alloy is generally melted and cast in a vacuum or under an inert gas. When a sintered magnet is obtained from casting a R-T-B-based alloy ingot by a powder metallurgy method, in general, an alloy ingot is crushed to obtain alloy powder having a particle size of about 3 μm (as measured by means of FSSS (Fisher Sub-Sieve Sizer)), the powder is subjected to pressing in a magnetic field, the obtained compact is sintered in a sintering furnace at about 1,000 to 1,100° C., the sintered product is heated, mechanically processed, and plated for corrosion prevention, and a sintered magnet is obtained.

The R-rich phase plays the following important roles in the R-T-B-based sintered magnet.

(1) Since the R-rich phase has a low melting point, the phase liquefies during sintering, thereby contributing to achievement of high remanence, leading to improved magnetization.

(2) The R-rich phase functions to smoothen grain boundaries, thereby reducing the number of nucleation sites of reversed magnetic domains, thereby enhancing the coercive force.

(3) The R-rich phase magnetically insulates the main phase, thereby enhancing the coercive force.

When the distribution of the R-rich phase in a cast magnet is inferior, sintering may be partially defective, and magnetic properties may be decreased. Therefore, it is important to disperse uniformly the R-rich phase into the cast magnet. The distribution of the R-rich phase depends greatly on the microstructure of raw material, an R-T-B-based alloy.

Another problem involved in casting of the R-T-B-based alloy is that α-Fe is formed in the cast alloy. The α-Fe has deformability, and remains in a crusher, without being crushed. Due to this, α-Fe not only deteriorates crushing efficiency during the crushing of the alloy, but also changes the composition before and after crushing, and greatly affects the particle distribution. In addition, if α-Fe remains even after sintering, magnetic characteristics of the sintered product are deteriorated.

In order to solve the above problems caused by formation of α-Fe in the R-T-B-based alloy, a strip casting method (abbreviated as SC method), in which an alloy ingot is cast with a higher cooling rate has been developed, and employed in actual production steps.

In the SC method, an alloy is rapidly solidified by pouring a molten alloy onto a rotating copper roller, the inside of which is cooled by water, to cast a strip having a thickness of about 0.1 to about 1 mm. During casting, the molten alloy is supercooled to the formation temperature of $R_2T_{14}B$ or less, which is the main phase. Therefore, it is possible to form directly $R_2T_{14}B$ from the molten alloy. Due to this, it is possible to prevent the formation of α-Fe.

In addition, since the crystalline structure of the alloy is minutely dispersed, it is possible to form an alloy having a structure in which an R-rich phase is finely dispersed. The R-rich phase reacts with hydrogen in a hydrogen atmosphere, expands, and forms brittle hydride (hydrogen decrepitation step). It is possible to generate fine cracks using the R-rich phase. When an alloy is finely crushed after the hydrogen decrepitation step, since the alloy is broken due to a lot of fine cracks, which are formed by the hydrogenation, crushability of the alloy is excellent.

As explained above, since the R-rich phase is minutely dispersed in the alloy ingot produced through the SC method, dispersion of R-rich phase in the product obtained by crushing and sintering the alloy also becomes satisfactory. Thereby, it is possible to improve magnetic properties of the obtained magnet (For example, Patent Document No. 1)

In addition, the alloy flakes, which are cast by the SC method, have superior uniformity of microstructure. The uniformity in microstructure can be evaluated based on a crystal grain size and the dispersion state of the R-rich phase. In alloy flakes formed by the SC method, chill crystals sometimes generate on a side which contacts with a cast roller (abbreviated as "cast surface side" below). Therefore, it is possible to obtain a reasonably fine and uniform microstructure by rapid solidification.

As explained above, the R-T-B-based alloy obtained by the SC method has a finely dispersed R-rich phase, and the formation of α-Fe is also prevented. Therefore, when a sintered magnet is obtained, uniformity of the R-rich phase in the final magnet product is improved, and crushing and adverse effects due to α-Fe can be prevented. In this way, the R-T-B-based alloy ingot obtained by the SC method has superior microstructure for producing sintered magnets.

Patent Document No. 1: Japanese Unexamined Patent Application, First Publication No. H5-222488

DESCRIPTION OF THE INVENTION

Problem to be Solved by the Invention

It has been required that the R-T-B-based alloys obtained by the SC method are further improved.

As explained above, the R-T-B-based alloy contains mainly R, T, and B (boron), where R denotes Nd, a part of which is replaced with at least one of rare-earth elements including Y. T means an alloy containing Fe as an essential component, and Co, Ni, etc.

In general, heat resistance of the R-T-B-based alloy is determined depending on coercive force. As the compositional ratio of Dy and Tb in the R-T-B-based alloys becomes higher, coercive force also increases. However, when Dy or Tb is added in alloys, coercive force increases, but remanence tends to be decreased. Therefore, it is difficult to satisfy demands by customers by only increasing the compositional ratio of Dy and Tb.

In consideration of the above-described problems, it is an object of the present invention to provide an apparatus for producing an alloy containing a rare-earth element, which can produce a rare-earth magnet having high coercive force, and decrease Br (remanence) due to addition of Dy and Tb minimum.

Means for Solving the Problem

In order to achieve the object, the present invention provides the following inventions.

[1] An apparatus for producing an alloy, wherein the device includes at least a casting device for casting a molten alloy by the SC method, a crushing device for crushing a cast alloy after casting, a heat-retaining device for maintaining the temperature of cast alloy flakes supplied from the crushing device, and a storage container for storing the cast alloy flakes after maintaining the temperature, the heat-retaining device including a heat-retaining container for storing the cast alloy flakes supplied from the crushing device, a heater for maintaining the temperature of the cast alloy flakes in the heat-retaining container, and an inclination device for inclining the heat-retaining container and sending the cast alloy flakes in the heat-retaining container to the storage container.

[2] The apparatus for producing an alloy according to [1], wherein the inclination device sends the cast alloy flakes to the storage container after a specific period of heat-retaining time since the cast alloy flakes are stored in the heat-retaining container.

[3] The apparatus for producing an alloy according to [1] or [2], wherein the heater is arranged on a wall and/or a bottom of the heat-retaining container.

[4] The apparatus for producing an alloy according to any one of [1] to [3], wherein the heater is arranged above the heat-retaining container.

[5] The apparatus for producing an alloy according to any one of [1] to [4], wherein the heater is arranged below the heat-retaining container.

[6] The apparatus for producing an alloy according to any one of [1] to [5], wherein the inclination device includes at least a pair of conveyor rollers, an endless conveyor belt which drives so as to rotate between a pair of the conveyor rollers, and a fixing member for fixing slidably the heat-retaining container on a conveyor surface of the endless conveyor belt, the heat-retaining container being inclined when a moving direction of the endless conveyor belt is reversed by either conveyor roller of a pair of the conveyor rollers.

[7] The apparatus for producing an alloy according to [6], wherein a plurality of the heat-retaining containers is fixed to the endless conveyor belt.

[8] The apparatus for producing an alloy according to any one of [1] to [5], wherein the inclination device includes a rotation shaft provided to the heat-retaining container, and a movable device for inclining the heat-retaining container by inclining the rotation shaft.

[9] The apparatus for producing an alloy according to [8], wherein the heat-retaining container has an inlet hole for the cast alloy flakes at the upper part, and an openable outlet portion for the cast alloy flakes at the side part.

[10] The apparatus for producing an alloy according to any one of [1] to [9], wherein the casting device, the crushing device, and the heat-retaining device are arranged inside of a chamber in an inert gas atmosphere.

[11] The apparatus for producing an alloy according to [10], wherein a cooling chamber is provided in the chamber, and the storage container is stored so as to be able to move to the cooling chamber.

[12] The apparatus for producing an alloy according to any one of [1] to [11], wherein the alloy is a rare-earth element containing alloy.

[13] The apparatus for producing an alloy according to [12], wherein the rare-earth element containing alloy is an R-T-B-based alloy (wherein R is at least one element selected from the group consisting of rare-earth elements including Y, T is an alloy containing Fe as an essential component, and B is boron).

[14] The apparatus for producing an alloy according to any one of [1] to [11], wherein the alloy is a hydrogen storage alloy.

[15] The apparatus for producing an alloy according to any one of [1] to [11], wherein the alloy is a thermoelectric semiconductor alloy.

[16] An alloy produced by the apparatus for producing an alloy according to any one of [1] to [11].

[17] A rare-earth element containing alloy produced by the apparatus for producing an alloy according to any one of [1] to [11].

[18] A hydrogen storage alloy produced by the apparatus for producing an alloy according to any one of [1] to [11].

[19] A thermoelectric semiconductor alloy produced by the apparatus for producing an alloy according to any one of [1] to [11].

[20] A rare-earth magnet made of the rare-earth element containing alloy according to [17].

Effect of the Invention

The apparatus for producing an alloy according to the present invention includes a heat-retaining container for storing the cast alloy flakes supplied from the crushing device, a temperature retaining heater for maintaining the temperature of the cast alloy flakes in the heat-retaining container, and an inclination device for sending the cast alloy flakes in the heat-retaining container to the storage container by inclining the heat-retaining container. Therefore, it is possible to improve various properties of the obtained alloy by retaining the temperature of the cast alloy flakes after crushing.

In particular, when the alloy is the R-T-B-based alloy, the coercive force can be improved by retaining the temperature. Therefore, it is possible to produce a rare-earth element magnet having high coercive force without increasing the compositional ratio of Dy and Tb in the R-T-B-based alloy.

EXPLANATION OF REFERENCE SYMBOLS

| | |
|---|---|
| 1, and 10: apparatus for producing an alloy | 2: casting device |
| 3 and 30: heat-retaining device | 5: container (storage container) |
| 6: chamber | 6a: casting chamber |
| 6b: heat-retaining and storing chamber | 6e: gate |
| 21: crushing device | |
| 31a: upper temperature retaining heater | |
| 31b: lower temperature retaining heater | 31c: flake injection hole |
| 32 and 52: heat-retaining container | 32a and 52a: opening portion |
| 33: belt conveyor (inclination device) | 33a: end portion |
| 35: endless conveyor belt | 51: belt conveyor (movable device) |
| 53: gate plate | 53a: outlet portion |
| 55: rotation shaft | L: molten alloy |
| N: cast alloy flakes | |

BEST MODE OF CARRYING OUT THE INVENTION

Below, the apparatus for producing an alloy of the present invention is explained in detail referring to figures. Moreover, figures, which are referred to in the following explanations, are for explaining the structure of the apparatus for producing an alloy, and a size, a thickness, etc. of each part illustrated may differ from the real size, thickness, etc. in the apparatus for producing an alloy.

[Total Structure of the Production Apparatus for an Alloy]

Figure 1:
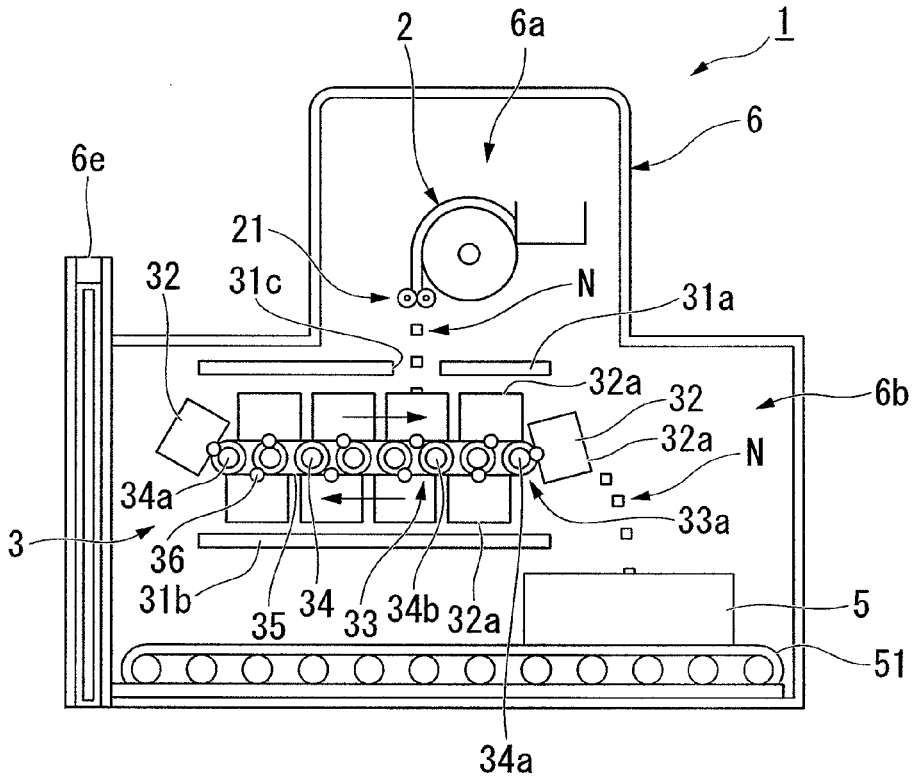
FIG. 1 is a schematic elevation view showing one embodiment of the apparatus for producing an alloy of the present invention.

FIG. 1 is a schematic elevation view showing one embodiment of the apparatus for producing an alloy of the present invention.

The production apparatus 1 for an alloy (abbreviated as "production apparatus" below) shown in FIG. 1 includes mainly a casting device 2 for casting the molten alloy, a crushing device 21 for crushing a cast alloy after casting, a heat-retaining device 3 for maintaining the temperature of cast alloy flakes after crushing, and a storage container 5 for storing the cast alloy flakes after maintaining the temperature.

The production apparatus 1 shown in FIG. 1 is stored in a chamber 6. The inside of the chamber 6 is in an inert gas atmosphere under reduced pressure. As the inert gas, for example, argon is used. In the chamber 6, there are a casting chamber 6*a*, and a heat-retaining and storing chamber 6*b*, which is arranged below the casting chamber 6*a* and connected with the casting chamber 6*a*. In the casting chamber 6*a*, the casting device 2 and the crushing device 21 are stored. In the heat-retaining and storing chamber 6*b*, the heat-retaining device 3 is stored. In this way, the heat-retaining device 3 is arranged below the crushing device 21.

In the heat-retaining and storing chamber 6*b*, the container 5 is arranged below the heat-retaining device 3. The container 5 is made of various metals, which can be used under high temperatures, such as stainless, iron, HASTELLOY®, and INCONEL®. The production apparatus 1 is provided with a belt conveyor 51 (movable device), which moves the container 5. The container 5 can move in the horizontal direction in FIG. 1 by being arranged on the belt conveyor 51.

In addition, the heat-retaining and storing chamber 6*b* has a gate 6*e*. The heat-retaining and storing chamber 6*b* is hermetically closed by the gate 6*e* except when the container 5 is transferred outside the heat-retaining and storing chamber 6*b*.

Moreover, a cooling chamber may be provided to the heat-retaining and storing chamber 6*b* on the opposite side of the gate 6*e*. Furthermore, it possible to provide another gate in the cooling chamber to transfer the container 5 to the outside of the chamber 6.

[Structure of the Casting Device]

Figure 2:
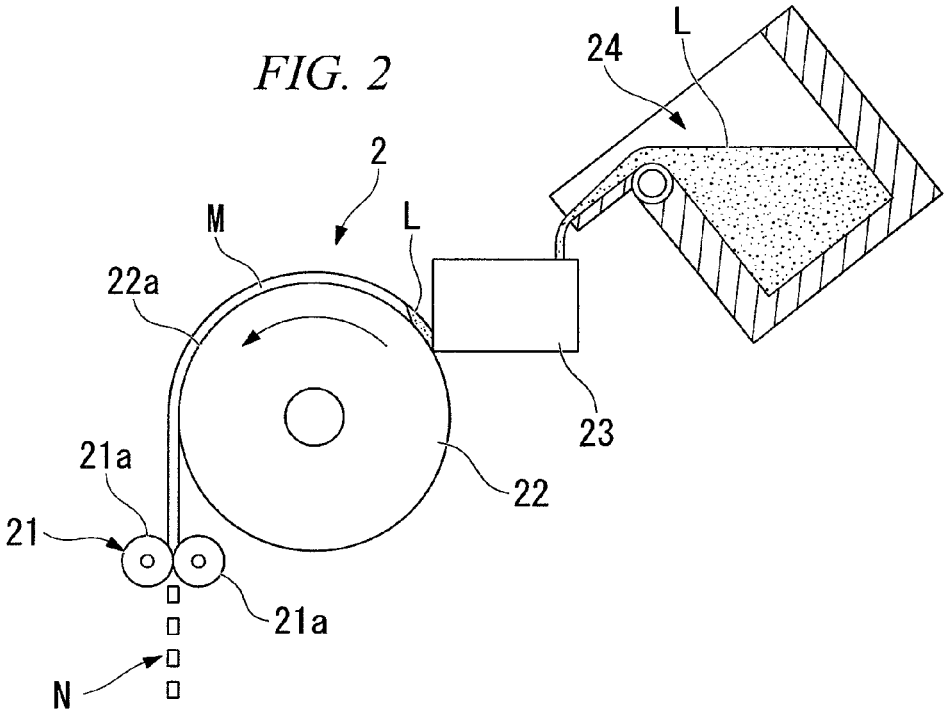
FIG. 2 is a schematic view showing the casting device and the crushing device in the apparatus for producing an alloy according to the present invention.

FIG. 2 is a schematic view showing the casting device 2 and the crushing device 21 in the production apparatus 1. The casting device 2 shown in FIG. 2 casts a molten alloy by the SC method. The crushing device 21 crushes the cast alloy to form cast alloy flakes. In the crushing device 2 shown in FIG. 2, reference number 22 denotes a cooling roller having a diameter in a range of from about 60 to 80 mm for rapidly cooling the molten alloy L and casting to obtain a cast alloy M. Reference number 23 denotes a tundish for supplying the molten alloy L onto the cooling roller 22. In the crushing device 2 shown in FIG. 2, the cast alloy M obtained by the cooling roller 22 is crushed by the crushing device 21 to form the cast alloy flakes N.

The molten alloy L is produced in a high frequency melting furnace (not shown in Figures) which is outside of the chamber 6. In the high frequency melting furnace, a molten metal is prepared by putting raw materials into a refractory crucible 24 under a vacuum or an inert gas atmosphere, and making molten the raw materials by a high frequency melting process. Although the temperature of the molten metal L varies depending on the composition of the alloy, it is adjusted to a range of from 1300° C. to 1500° C. The prepared molten metal L is transferred to the casting device 2, together with the refractory crucible 24. Then, the molten alloy L is supplied from the refractory crucible 24 into the tundish 23.

The tundish 23 has a rectifier device or a slag removal device, if necessary.

The cooling roller 22 has a water cooling device, which is not shown in figures, inside thereof. The circumference 22*a* of the cooling roller 22 is cooled by the water cooling device. The material constituting the cooling roller 22 is preferably copper or a copper alloy, because it has high thermal conductivity and is easily obtainable. The supply rate of the molten alloy L and the revolution speed of the cooling roller 22 are controlled according to the thickness of the casting alloy M. The surface speed of the cooling roller 22 is preferably in a range of from 0.5 to 3 m/s of the rotating speed, since an alloy easily adheres to the peripheral surface 22*a* of the cooling roller 22, depending on the construction material of the cooling roller 22, or the surface state of the peripheral surface 22*a*. Therefore, when a cleaning device is installed depending on necessity, the quality of the cast R-T-B-based alloy is stabilized. The cast alloy M solidified on the cooling roller 22 falls off the cooling roller 22 on the opposite side of the tundish 23.

As shown in FIGS. 1 and 2, for example, the crushing device 21 has a pair of crushing rollers 21*a*. When the cast alloy M is applied between two crushing rollers 21*a* and 21*a*, the cast alloy M is crushed to form cast alloy flakes N. The cast alloy flakes N fall, and are sent to the heat-retaining device 3, as shown in FIG. 1.

[Structure of the Heat-Retaining Device]

As shown in FIG. 1, the heat-retaining device 3 has a plural heat-retaining containers 32, a temperature retaining heater, which maintains the temperature of the heat-retaining container 32 and the cast alloy flakes N in the heat-retaining container 32, and a belt conveyor (inclination device) 33.

The heat-retaining container 32 stores the cast alloy flakes N which have fallen from the crushing device 21. The heat-retaining container 32 is made of a material having high thermal insulation properties, for example, a ceramic block, such as alumina block and zirconia block, a fibrous plate, or a complex material in which plural metal thin plates are deposited with a gap.

After the temperature is maintained for a fixed period of time since the cast alloy flakes N are stored in the heat-retaining container 32, the belt conveyor 33 makes the heat-retaining container 32 incline to send out the cast alloy flakes N in the heat-retaining container 32 into the container 5.

The belt conveyor 33 has plural conveyor rollers 34 which extend in a substantially horizontal direction, an endless ring-shaped conveyor belt 35 which is installed on the periphery of the plural conveyor rollers 34, and a fixing member 36 for fixing the heat-retaining container 32 on the conveyor surface of the endless conveyor belt 35 so as to swing.

The plural conveyor rollers 34 include a pair of end rollers 34*a* and 34*a* which are arranged on both sides, and intermediate rollers 34*b* which are arranged between the end rollers 34*a* and 34*a*.

The belt conveyor 33 makes the heat-retaining container 32 incline while the transfer direction of the endless conveyor belt 35 is reversed by one end roller 34*a*.

The heat-retaining container 32 is fixed on the exterior surface of the endless conveyor belt 35 such that the opening portion 32*a* faces outwardly. The heat-retaining container 32 circles on the outside of the endless conveyor belt 35, while the opening portion 32 faces outwardly, by rotating the conveyor rollers 34.

Specifically, the cast alloy flakes N are supplied from the crushing device 21 to the heat-retaining container 32 having the open portion 32*a* facing outwardly during moving. Then, when the heat-retaining container 32 is made to incline at the end portion 33*a* of the belt conveyor 33 in the transfer direction, the cast alloy flakes N in the heat-retaining container 32 are sent to the container 5.

In addition, it is possible to control the time after storing the cast alloy flakes N in the heat-retaining container 32 before sending them to the container 5 by adjusting the moving speed of the heat-retaining container 32.

The temperature retaining heater in the heat-retaining device 3 shown in FIG. 1 has an upper heater 31*a*, and a lower heater 31*b*. The upper heater 31*a* is arranged above the heat-retaining container 32. The upper heater 31*a* heats the moving heat-retaining container 32 while the opening portion 32*a* faces upwardly, from above. The lower heater 31*b* is arranged below the heat-retaining container 32. The lower heater 31*b* heats the moving heat-retaining container 32 while the opening portion 32*a* faces downwardly, from the bottom.

In addition, a flake injection hole 31*c* for supplying the cast alloy flakes N from the crushing device 21 to the heat-retaining container 32 is formed in a part of the upper heater 31*a*. As shown in FIG. 1, the flake injection hole 31*c* is arranged below the crushing device 21.

The heating manner of the upper and lower heaters 31*a* and 31*b* is not particularly limited. For example, resistance heating, infrared-ray heating, and induction heating are used.

In addition, since a heating element in the upper and lower heaters 31*a* and 31*b* may be a metal wire, silicon carbide, black lead, etc. can be used.

[Operation of the Production Apparatus]

Next, operation of the production apparatus 1 is explained.

As shown in FIG. 1, the upper heater 31*a* is arranged such that the flake injection hole 31*c* of the upper heater 31*a* is positioned below the crushing device 21. The container 5 is arranged so as to store the cast alloy flakes N from the moving heat-retaining container 32 at the end portion 33*a* of the belt conveyor 33 in the transfer direction.

In addition, the heat-retaining container is rotated by operating the belt conveyor 33. The temperature of the heat-retaining container is raised to a fixed temperature by switching on the upper and lower heaters 31*a* and 31*b*.

Then, the cast alloy flakes N are produced by operating the crushing device 21. In order to prepare the cast alloy flakes N, a molten alloy L is prepared using a melting device not shown in figures. Then, as shown in FIG. 2, the molten metal L in the refractory crucible 24 is supplied to the tundish 23. Subsequently, the molten metal L is supplied onto the cooling roller 22 from the tundish 23, and the molten metal is solidified to make the cast alloy M. Then, the cast alloy flakes N are obtained by removing the cast alloy M from the cooling roller 22, and crushing between the crushing rolls 21*a*.

For example, the molten metal L has a composition expressed by a general formula, R-T-B. In the general formula, R denotes at least one of rare-earth elements including Y. T means Fe which is partially replaced with a metal, such as Co, and Ni. B is boron, or boron which is partially replaced with C or N. In addition, other elements such as Cu, Al, Ti, V, Cr, Ga, Mn, Nb, Ta, Mo, W, Ca, Sn, Zr, and Hf may be added, to the R-T-B-based alloys, singly or in combination of two or more species.

The composition ratio of R is 28 to 33% by mass, B is 0.9 to 1.3% by mass, and T is the remainder. It is possible that a part of R be replaced with 15% by mass of Dy and/or 15% by mass of Tb.

The composition of the molten metal L used in the production apparatus 1 is not limited to the above ranges. Any composition can be used as long as it is a R-T-B-based alloy.

It is preferable that the average cooling rate of the molten alloy on the cooling roller be adjusted to a range of from 300 to 3000° C. per second. When it is 300° C. per second or more, the cooling rate is sufficient, and the precipitation of α-Fe, and coarsening of the $R_2T_{17}$ phase can be more reliably prevented. In contrast, when it is less than 3,000° C. per second, supercooling is not excessive, and it is possible to supply the cast alloy flakes to the heat-retaining device 3 maintaining more adequate temperatures. In addition, the cast alloy flakes are not cooled more than necessary. Therefore, reheating of the cast alloy flakes is not necessary.

Moreover, an average cooling rate is calculated by dividing the temperature difference of the molten alloy between just before contacting the cooling roller 22 and when removing from the cooling roller 22 by the period of time during contacting with the cooling roller 22.

In addition, the average temperature of the cast alloy M when removing from the cooling roller 22 varies depending on slight variation of contacting conditions between the cast alloy M and the cooling roller 22, or the thickness of the cast alloy M. The average temperature of the cast alloy M when removing from the cooling roller 22 is obtained by averaging the measurement values obtained by measuring the surface of the alloy in the width direction throughout the casting using a radiation thermometer.

It is preferable that the average temperature of the cast alloy M when removing from the cooling roller 22 be a temperature which is 100° C. to 500° C. less than the solidification temperature of the molten alloy when the $R_2T_{14}B$ phase is in equilibrium, and a temperature which is 100° C. to 400° C. less than the solidification temperature is more preferable. When the $R_2T_{14}B$ phase is made of Nd—Fe—B, the melting point is 1,150° C. This melting point varies by replacing Nd with another rare-earth element, Fe with another transition element, or kind and amount of another additive element added.

When the difference between the average temperature of the cast alloy M when removing from the cooling roller 22 and the solidification temperature of the cast alloy M when the $R_2T_{14}B$ phase is in equilibrium is less than 100° C., the cooling rate is insufficient. In contrast, when the difference is 500° C. or more, the cooling rate is too fast. When the molten alloy is supercooled, the conditions of the alloy are not uniform within the alloy, and vary depending on the contact degree between the molten alloy L and the cooling roller 22, or the distance from the contacting portion on the cooling roller 22.

Next, as shown in FIG. 1, the cast alloy flakes N, which are crushed by the crushing device 21, fall and pass through the flake injection hole 31*c*, and then are stored in the heat-retaining container 32 below the crushing device 21. At this time, the temperature of the heat-retaining container 32 is adjusted to a fixed temperature by the upper heater 31*a* and the lower heater 31*b*.

In the production apparatus 1 shown in FIG. 1, the cast alloy flakes N are continuously supplied to the heat-retaining container 32 from the crushing device 21 with a predetermined supply amount. Since the heat-retaining containers 32 are rotated by the belt conveyor 33 in the heat-retaining device 3, the cast alloy flakes N supplied from the crushing device 21 are in series put into the heat-retaining containers 32 which are heated by the upper and lower heaters 31*a* and 31*b*. After maintaining the temperature during a predetermined time, the cast alloy flakes N are sent to the container 5.

Next, each heat-retaining container 32 is explained.

The temperature of the empty heat-retaining container 32, of which the opening portion 32*a* faces upwardly, is maintained at predetermined temperatures by heating with the upper heater 31*a* while moving from the left-hand side to right-hand side in FIG. 1 by the belt conveyor 33. When the heat-retaining container 32 with a predetermined temperature reaches a position below the flake injection hole 31*c* of the upper heater 31*a*, the cast alloy flakes N are supplied from the crushing device 21 to the heat-retaining container 32. Then, the temperature of the cast alloy flakes N starts be maintained.

After that, the heat-retaining container 32 containing the cast alloy flakes N moves further from the left-hand side to right-hand side in FIG. 1 while being heated by the upper heater 31*a* and maintaining the temperature of the cast alloy flakes N. The heat-retaining container 32 which reaches the end portion 33*a* of the belt conveyor 33 turns over. Due to this, the direction of the opening portion 32*a* of the heat-retaining container 32 changes from upwardly to downwardly. The cast alloy flakes N in the heat-retaining container 32 are sent to the container 5 by the inclination and reversing of the heat-retaining container 32. Then, maintaining the temperature of the cast alloy flakes N is finished.

Moreover, the period of time after the cast alloy flakes N are stored in the heat-retaining container 32 before the cast alloy flakes N are sent to the container 5 is adjusted by controlling the moving speed of the heat-retaining container 32 by the belt conveyor 33 in the heat-retaining device 3 shown in FIG. 1.

Then, the temperature of the empty heat-retaining container 32 of which the opening portion 32*a* faces downwardly is maintained at specific temperatures by heating with the lower heater 31*b* while moving from the right-hand side to left-hand side in FIG. 1 by the belt conveyor 33. The heat-retaining container 32, which reaches the opposite end in the transfer direction of the belt conveyor 33, inclines and turns over. Thereby, the direction of the opening portion 32*a* of the heat-retaining container 32 changes from downwardly to upwardly. Then, the heat-retaining container 32 is heated by the upper heater 31*a* again, and starts to move from the left-hand side to right-hand side in FIG. 1 by the belt conveyor 33.

In this embodiment, it is preferable that the temperature of the heat-retaining container 32, that is, the maintaining temperature of the cast alloy flakes, be less than the temperature of the cast alloy flakes N when moving from the cooling roller 22 (abbreviated as "cooling roller removing temperature" below). Specifically, the temperature is preferably in a range of from (cooling roller removing temperature −100° C.) to the cooling roller removing temperature, and more preferably in a range of from (cooling roller removing temperature −50° C.) to the cooling roller removing temperature. More specifically, it is preferably in a range of from 600° C. to 900° C.

When the temperature of the cast alloy flakes N is maintained in the range, it is possible to improve the coercive force of the R-T-B-based alloy. When the maintaining temperature is 600° C. or more, the coercive force can be further improved. In contrast, when it is less than 900° C., it is possible to prevent more reliably the formation of α-Fe, and coarsening of the $R_2T_{17}$ phase.

Moreover, when the temperature of the cast alloy flakes N is maintained at 1,000° C. or more, the coercive force is also improved. However, when the cast alloy flakes N are maintained at 1,000° C., the microstructure becomes coarse. Therefore, the grain size distribution, fluidity, and sintering temperature after crushation vary. Due to this, it is necessary to consider the effects after maintaining the temperature in a case of maintaining the cast alloy flakes N at 1,000° C.

When the cooling roll removing temperature falls for a any reason, it is possible to raise and maintain the temperature of the cast alloy flakes N by controlling the upper heater 31*a* and/or the lower heater 31*b*, and making the maintaining temperature higher than the cooling roller removing temperature. Thereby, the temperature of the cast alloy flakes N can be raised and maintained. In this case, the raising temperature range is preferably 100° C. or less, and more preferably 50° C. or less. When the raising temperature range is larger than 100° C., productivity may be decreased.

The heat-retaining time of the cast alloy flakes N is preferably 30 seconds or more, more preferably in a range of from 30 seconds to several hours, and most preferably in a range of from 30 seconds to 2 minutes. When the heat-retaining time is 30 seconds or more, the coercive force can be further improved. It is possible to maintain for several hours. However, in terms of the productivity, 2 minutes or less is preferable.

There is a heat-retaining time lag between the cast alloy flake N which is supplied at first and the cast alloy flake N which is supplied at the end. In this embodiment, it is preferable that the heat-retaining time of the cast alloy flake N which is supplied at first and the heat-retaining time of the cast alloy flake N which is supplied at the end is also adjusted in that range.

The cast alloy flakes N, which are sent to the container 5 after maintaining the temperature thereof by the heat-retaining device 3, are collected in the container 5 uniformly in the horizontal direction, because the container 5 moves in the horizontal direction in FIG. 1 by the belt conveyor 51.

The cast alloy flakes N collected in the container 5 are cooled by contacting the inner wall of the container 5. The cast alloy flakes N in the container 5 are transferred outside of the chamber 6 by opening the gate 6*e* of the heat-retaining and storing chamber 6*b*, and transferring the container 5 to the outside of the chamber 6.

When the cooling chamber is formed in the chamber 6, the cast alloy flakes N in the container 5 are cooled by opening the gate 6*e* of the heat-retaining and storing chamber 6*b*, and transferring the container 5 to the cooling chamber. Then, after cooling the cast alloy flakes N, the gate of the cooling chamber is opened, and the container 5 is transferred outside of the chamber 6.

As explained above, the production apparatus shown in FIG. 1 has the heat-retaining device 3, which includes the heat-retaining container 32 for storing the cast alloy flakes N supplied from the crushing device, a temperature retaining heater for maintaining the temperature of the cast alloy flakes N in the heat-retaining container 32, and the belt conveyor 33 for sending the cast alloy flakes N in the heat-retaining container 32 to the container 5 by inclining the heat-retaining container 32. Therefore, it is possible to maintain the temperature of the cast alloy flakes N containing the R-T-B-based alloy after crushing. Due to this, it is also possible to obtain the cast alloy flakes N, which are a raw material of the rare-earth magnet having high coercive force and high thermal resistance without increasing the compositional ratio of Dy and Tb in the R-T-B-based alloy.

In addition, according to the production apparatus 1 shown in FIG. 1, after the cast alloy flakes N are stored in the heat-retaining container 32, a specific period of time elapses, then the belt conveyor 33 sends the cast alloy flakes N into the container 5. Therefore, it is possible to further improve the coercive force of the cast alloy flakes N.

In addition, the belt conveyor 33 in the production apparatus shown in FIG. 1 has the endless conveyor belt 35, which rotates and is installed on the periphery of the conveyor rollers 34, and a fixing member 36 which fixes the heat-retaining container 32 on the surface of the endless conveyor belt 35 so as to swing. The belt conveyor 33 makes the heat-retaining container 32 incline when the transfer direction of the endless conveyor belt 3135 is reversed by the roller 34*a* at one end. The time after the cast alloy flakes N are stored in the heat-retaining container 32 before the cast alloy flakes N are sent to the container 5, that is, heat-retaining time, can be controlled by adjusting the moving speed of the heat-retaining container 32 by the belt conveyor 33. Therefore, it is possible to maintain the heat-retaining time of the cast alloy flakes N at a specific period of time. Due to this, it is also possible to make uniform the quality of the cast alloy flakes N.

In addition, the heat-retaining container 32 rotates by the belt conveyor 33 in the heat-retaining device 3 shown in FIG. 1. Thereby, the cast alloy flakes N supplied from the crushing device 21 are successively stored in the heat-retaining containers 32. Due to this, the cast alloy flakes N do not exist at one place in the heat-retaining container 32. That is, it is possible to store uniformly the cast alloy flakes N in the heat-retaining container 32. Thereby, it is possible to maintain uniformly the temperature of the cast alloy flakes N in the heat-retaining container 32, and the cast alloy flakes N having uniform quality can be obtained.

In addition, the heat-retaining device 3 has the upper heater 31*a* for heating the heat-retaining container 32 having the open portion 32*a* facing upwardly while moving. The flake injection hole 31*c* is formed at a part of the upper heater 31*a*. The flake injection hole 31*c* is below the crushing device 21. Due to this, the cast alloy flakes N can be supplied from the crushing device 21 into the heat-retaining container 32 having the opening portion 32*a* facing upwardly while moving. At the same time, the heat-retaining container 32 having the opening portion 32*a* facing upwardly can be heated from the upper portion.

In addition, since the heat-retaining device 3 is arranged below the crushing device 21, the cast alloy flakes N can be supplied from the crushing device to the heat-retaining device 3 by only making the cast alloy flakes N fall. Therefore, it is not necessary to use a transfer mechanism for transferring the cast alloy flakes N from the crushing device 21 to the heat-retaining device 3. The size of the production apparatus 1 can be reduced, and space for the production apparatus 1 can also be reduced.

In addition, the heat-retaining device 3 has the lower heater 31*b* for heating the heat-retaining container 32 having the opening portion 32*a* facing downwardly from the lower portion. The heat-retaining container 32 having the opening portion 32*a* facing downwardly can be heated at specific temperatures. Thereby, the temperature of the heat-retaining container 32 when the cast alloy flakes N are supplied to the heat-retaining container 32 can be easily adjusted to the specific temperature range.

Since it has the belt conveyor 51 which makes the container 5 move, the cast alloy flakes N after maintaining the temperature can be collected uniformly in the container 5 by moving the container 5 with the belt conveyor 51. Thereby, it is possible to obtain the cast alloy flakes N having uniform quality. In addition, it has the belt conveyor 51 which makes the container 5 move freely, the cast alloy flakes N after maintaining the temperature can be easily transferred out of the production apparatus 1.

In addition, since the casting device 2 has the crushing device 21, the cast alloy ingot is promptly crushed to make the cast alloy flakes N. Thereby, the cast alloy can be easily handled in the container 5 and the heat-retaining device 3.

In addition, since the casting device 2 and heat-retaining device 3 are arranged in the chamber 6 in an inert gas atmosphere, deterioration of R-T-B-based alloy can be prevented.

When the cooling chamber is in the chamber 6, since the container 5 can move into the cooling chamber, it is possible to transfer the cast alloy flakes N after maintaining the temperature together with the container 5 out of the heat-retaining and storing chamber 6*b* to cool them. Thereby, it is possible to improve the productivity.

In addition, when the rare-earth element containing alloy is the R-T-B-based alloy, it is possible to produce magnets having high coercive force and heat resistance using the production apparatus 1. The coercive force of the R-T-B-based alloy containing the rare-earth element containing alloy increases, when the compositional ratio of Dy and Tb increases. However, the remanence tends to decrease.

Since the production apparatus 1 has the heat-retaining device 3, the temperature of the R-T-B-based alloy can be maintained. Thereby, the coercive force of the magnet containing the R-T-B-based alloy can also be improved. Therefore, it is possible to decrease the compositional ratio of Dy and Tb. In addition, the remanence can be also improved by decreasing the compositional ratio of Dy and Tb.

Moreover, the heat-retaining device 3 is not limited to this embodiment. For example, when the heat-retaining device 3 has the upper and lower heaters 31*a* and 31*b* shown in FIG. 1, the maintaining temperature can be easily controlled exactly. Therefore, such a structure is preferable. However, when the heat insulation efficiency of the heat-retaining container 32 is sufficiently high, and the cast alloy flakes N in the heat-retaining container 32 can be kept at sufficiently high temperature for sufficient time, only either one of the upper and lower heaters 31*a* and 31*b* can be used.

In addition, for example, it is also possible for a heater to be fixed on the side wall and/or the bottom of the heat-retaining container 32, instead of or in addition to the upper and lower heaters 31*a* and 31*b*. In this case, it is possible to exactly control the maintaining temperature of the cast alloy flakes N.

Figure 3:
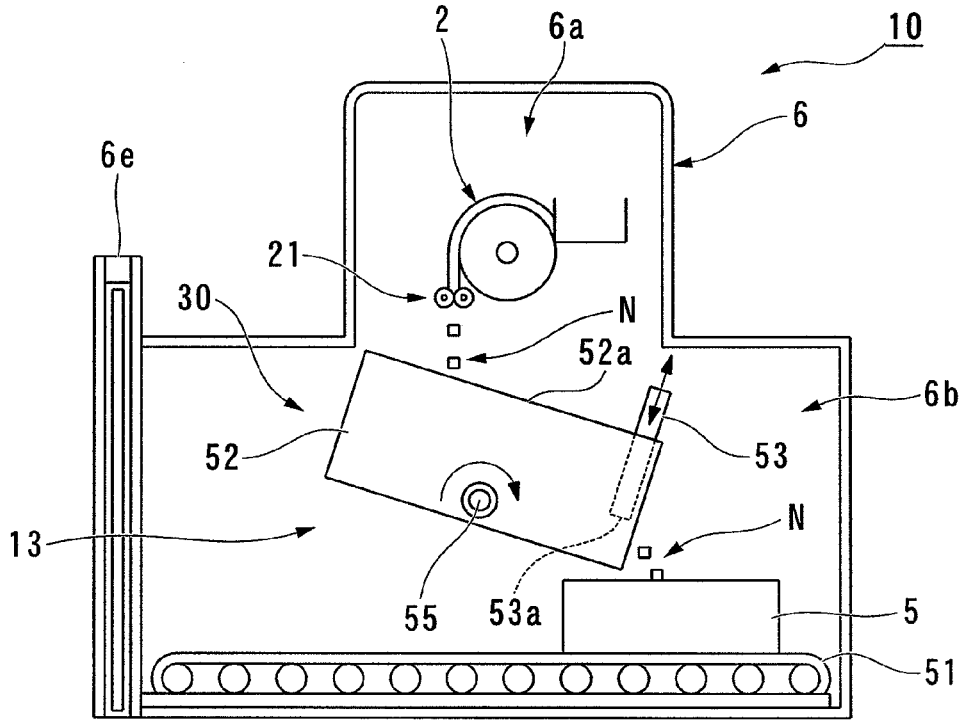
FIG. 3 is a schematic elevation view showing another embodiment of the apparatus for producing an alloy of the present invention.

The heat-retaining device 3 may have the structure shown in FIG. 3.

Similar to the heat-retaining device 3 shown in FIG. 1, the heat-retaining device 30 shown in FIG. 3 has a heat-retaining container 52 for storing the cast alloy flakes N supplied from the crushing device 21, a temperature retaining heater (not shown in FIG. 3), which maintains the temperature of the heat-retaining container 52 and the cast alloy flakes N in the heat-retaining container 52, and an inclination device 13 for inclining the heat-retaining container 52 to send the cast alloy flakes N in the heat-retaining container 52 into the container 5.

The inclination device 13 has a rotation shaft 55 provided with the heat-retaining container 52, and a movable device (not shown in FIG. 3) for rotating the rotational shaft 55 to incline and rotate the heat-retaining container 52.

The heat-retaining container 52 is supported while an opening portion 52*a* faces outwardly so as to be able to rotate by the rotation shaft 55 which extends in the substantially horizontal direction. The inclination and rotation of the heat-retaining container 52 are controlled by the movable device.

The heat-retaining container 52 has the opening portion 52*a* at the upper portion. The cast alloy flakes N are supplied into the heat-retaining container 52 through the opening portion 52*a*. In addition, the heat-retaining container 52 has an outlet portion 53*a* on one side wall (side portion), and a gate plate 53 which can move in the vertical direction so as to open or close the outlet portion 53*a*. The movement of the gate plate 53 in the vertical direction can be controlled by a moving device (not shown in FIG. 3).

That is, the cast alloy flakes N are supplied from the crushing device 21 into the heat-retaining container 52 through the opening portion 52*a*. Then, the gate plate 53 provided with the heat-retaining container 52 moves upwardly, and thereby the outlet portion 53*a* which has been closed by the gate plate 53 is opened. When the heat-retaining container 52 inclines and rotates by the movable device, the cast alloy flakes N are sent to the container 5 through the outlet portion 53*a*.

When the inclination and rotation of the heat-retaining container 52 is controlled by the movable device, and the movement of the gate plate 53 is controlled by the transfer device, it is possible to control the maintaining time after the cast alloy flakes N are stored in the heat-retaining container 52 before the cast alloy flakes N are sent to the container 5.

Similar to the heat-retaining device 3 shown in FIG. 1, the heat-retaining device 30 shown in FIG. 3 is made of a material having high thermal insulation properties, for example, a ceramic block, such as alumina block and zirconia block, a fibrous plate, or a complex material in which plural metal thin plates are deposited with a gap. Specifically, the heat-retaining device 30 is preferably made of a complex material in which a heat-resistant board containing fibrous ceramics is inserted between metal plates such as iron plates.

In the heat-retaining device 30 shown in FIG. 3, a heater (not shown in FIG. 3.) is provided on the side wall and/or bottom of the heat-retaining container 52. Heating manner of the heater is not particularly limited. For example, a heat generator, such as a metal wire, silicon carbide, black lead, etc. can be heated by any one heating manner of resistance heating, infrared-ray heating, and induction heating.

When the cast alloy flakes N are produced using the production apparatus 10 shown in FIG. 3, the cast alloy flakes N fallen from the crushing device 21 are stored in the heat-retaining container 52 below the crushing device 21. Thereby, the temperature of the cast alloy flakes N starts to be maintained. At this time, the temperature of the heat-retaining container 52 is adjusted to a specific temperature by the heater. The outlet portion 53*a* is closed by the gate plate 53. The heat-retaining container 52 storing the cast alloy flakes N is swung, within an angle range such that the cast alloy flakes N are not spilled, by the movable device, while the opening portion 52*a* faces upwardly. Thereby the cast alloy flakes N move in the heat-retaining container 52 and are stored uniformly. The cast alloy flakes N can be uniformly heated. After a fixed range of time elapses, the outlet portion 53*a* is formed on the side wall by moving the gate plate 53 by the movable device. At that time, the heat-retaining container 52 is inclined and rotated by the movable device. Thereby, the cast alloy flakes N in the heat-retaining container 52 are sent to the container 5 through the outlet portion 53*a*, and the maintaining temperature of the cast alloy flakes N is finished. The cast alloy flakes N after maintaining the temperature are collected in the container 5, similar to the production apparatus 1 shown in FIG. 1.

The heat-retaining time for the cast alloy flakes N is preferably 30 seconds or more, more preferably in a range of from 2 minutes to several hours, and most preferably in a range of from 2 minutes seconds to 30 minutes. When the heat-retaining time is 2 minutes or more, the coercive force can be further improved. It is possible to maintain for several hours. However, when the productivity is concerned, 30 minutes or less is preferable.

There is a heat-retaining time lag between the cast alloy flake N which is supplied at first and the cast alloy flake N which is supplied at the end. It is preferable that the heat-retaining time of the cast alloy flake N which is supplied at first and the heat-retaining time of the cast alloy flake N which is supplied at the end are both adjusted in that range.

The production apparatus 10 shown in FIG. 3 has the heat-retaining device 30, which includes the heat-retaining container 52 for storing the cast alloy flakes N supplied from the crushing device 21, the heater for maintaining the temperature of the cast alloy flakes N in the heat-retaining container 52, and the inclination device 13 for making the heat-retaining container 52 incline to send the cast alloy flakes N in the heat-retaining container 52 into the container 5. Therefore, similar to the production apparatus shown in FIG. 1, it is possible to keep the temperature of the cast alloy flakes N made of the R-T-B-based alloy after casting and crushing. Thereby, it is possible to produce the cast alloy flakes N which are a raw material of the rare-earth magnet having high coercive force and high thermal resistance without increasing the compositional ratio of Dy and Tb in the R-T-B-based alloy.

In addition, the production apparatus 10 shown in FIG. 3 has the inclination device 13 for sending the cast alloy flakes N into the container 5 after a fixed heat-retaining time passes since the cast alloy flakes N are stored in the heat-retaining container 52. Therefore, it is possible to further improve the coercive force of the cast alloy flakes N.

Since the inclination device 13 has the rotation shaft 55 provided with the heat-retaining container 52, and the movable device for rotating the rotational shaft 55 to incline and rotate the heat-retaining container 52. Therefore, the cast alloy flakes N, which are supplied from the crushing device 21, are stored in the heat-retaining container 52, and the cast alloy flakes N in the heat-retaining container 52 can be sent to the container 5 by inclining and rotating the heat-retaining container 52. At this time, it is possible to control the heat-retaining time of the cast alloy flakes N by controlling the inclination and rotation of the heat-retaining container 52. Therefore, it is also possible to maintain constantly the heat-retaining time of the cast alloy flakes N and make the quality of the cast alloy flakes N uniform.

In addition, the cast alloy flakes N in the heat-retaining container 52 can be sent to the container 5 by controlling the movement of the gate plate 53 and the rotation of the heat-retaining container 52. Therefore, it is possible to make the rotation angle of the heat-retaining container 52, when the cast alloy flakes N are sent, smaller, compared with a case in which the heat-retaining container 52 does not have the openable outlet portion 53*a* on the side wall, and the cast alloy flakes N are sent from the opening portion 52*a* formed upper portion of the heat-retaining container 52. Thereby, size of the production apparatus 10 can be reduced, and space for the production apparatus 10 can also be reduced.

In addition, the heat-retaining container 52 is rotatably supported such that the opening portion 52*a* faces outwardly by the rotational shaft 55 which extends in the substantially horizontal. Therefore, it is possible to swing the heat-retaining container 52 having the opening portion 52*a* facing upwardly within an angle range such that the cast alloy flakes N are not spilled, while maintaining the temperature of the cast alloy flakes N in the heat-retaining container 52. Thereby, the cast alloy flakes N can be stored uniformly in the heat-retaining container 52, and the temperature of the cast alloy flakes N in the heat-retaining container 52 can be uniformly kept. Therefore, the cast alloy flakes N having a uniform quality can be produced.

Moreover, for example, it is also possible to use the upper and lower heaters 31*a* and 31*b* in the production apparatus 1 shown in FIG. 1, instead of or in addition to the heater on the side wall and/or the bottom of the heat-retaining container 32. In this case, it is possible to exactly control the maintaining temperature of the cast alloy flakes N.

The production apparatus for an alloy of the present invention is not limited to the above embodiments. The constitution of the production apparatus according to the present invention can be changed as long as the change of the constitution is within the scope of the present invention.

For example, although the belt conveyor 51 is used as the movable device for moving freely the storage container, it is also possible to use a self-propelled storage container having a carriage with tires. Of course, it is also possible to set rails and make the carriage move along the rails.

In addition, a hopper for introducing the cast alloy flakes N above the heat-retaining container may be provided between the crushing device and the heat-retaining and storing device. In this case, it is possible to prevent scattering of the cast alloy flakes N into the heat-retaining and storing device, when the cast alloy flakes N are sent from the crushing device into the heat retaining device.

In addition, the production apparatus according to the present invention can be used not only for the R-T-B-based alloy, but also for a thermoelectric semiconductor alloy, or a hydrogen-storing metal alloy.

Examples of the thermoelectric semiconductor alloy can include alloys, which are shown by the general formula $A_{3-x}B_xC$ (in the general formula, A and B denote at least one element selected from the transition metals, such as Fe, Co, Ni, Ti, V, Cr, Zr, Hf, Nb, Mo, Ta, and W, C denotes at least one element selected from the elements in 13rd and 14th groups, such as Al, Ga, In, Si, and Ge).

In addition, alloys can be used, which are shown by the general formula ABC (in the general formula, A and B denote at least one element selected from the transition metals, such as Fe, Co, Ni, Ti, V, Cr, Zr, Hf, Nb, Mo, Ta, and W, C denotes at least one element selected from the elements in 13th and 14th groups, such as Al, Ga, In, Si, and Ge).

In addition, rare-earth elements containing alloys can also be used, which are shown by the general formula $RE_x(Fe_{1-y}M_y)_4Sb_{12}$ (in the general formula, RE means at least one of La and Ce, M denotes at least one element selected from the group consisting of Ti, Zr, Sn, and Pb, and x and y satisfy the relationship of $0<x\leqq 1$, and $0<y<1$).

Furthermore, rare-earth elements containing alloys can also be used, which are shown by the general formula $RE_x(Co_{1-y}M_y)_4Sb_{12}$ (in the general formula, RE means at least one of La and Ce, M denotes at least one element selected from the group consisting of Ti, Zr, Sn, Cu, Zn, Mn and Pb, and x and y satisfy the relationship of $0<x\leqq 1$, and $0<y<1$).

As the hydrogen-storing metal alloy, $AB_2$ type alloy (alloy containing a transition element, such as titanium, manganese, zirconium, and nickel, as a base), or $AB_5$ type alloy (alloys containing a rare-earth element, niobium, and zirconium, and at least one transition element having catalyst functions, such as nickel, cobalt, aluminum, etc. with a ratio of 1:5) can be used.

(Production of a Rare-Earth Permanent Magnet)

In order to produce the rare-earth permanent magnet of the present invention, for example, the cast alloy flakes containing the R-T-B-based alloy are finely pulverized such that the average particle diameter is in a range of from 3 to 5 μm (measured by a laser diffraction meter), the obtained powder is compacted using a molding device in a transverse magnetic field, and then this is sintered under vacuum conditions.

Since the rare-earth element containing magnet in this embodiment contains the R-T-B-based alloy produced by the production apparatus according to the present invention, the coercive force is high and magnetic properties are also excellent.

EXAMPLE

Example 1

In order to obtain a raw material, metal neodymium, metal dysprosium, ferroboron, cobalt, aluminum, copper, and iron were added to an aluminum crucible so that the raw material contained 28% of Nd, 4.5% of Dy, 0.96% of B, 1.0% of Co, 0.15% of Al, 0.10% of Cu, and the remainder of Fe as a mass ratio, and these were melted in a high frequency melting furnace in an argon gas atmosphere at 1 atm to prepare a molten alloy.

Subsequently, the molten alloy was supplied to the production apparatus shown in FIG. 1, and casted by the SC method, and the cast alloy flakes were produced.

Moreover, the diameter of the cooling roller was 600 mm, and the material constituting the cooling roller was an alloy containing a small amount of Cr and Zr, and Cu as the remainder. The inside of the cooling roller was cooled.

The rotating speed of the cooling roller during casting was 1.3 m/s. When the average temperature of the cast alloy when it was removed from the cooling roller was measured using a radiation thermometer, the average temperature was 890° C. The difference between the highest temperature and the lowest temperature was 35° C.

The melting point of the $R_2T_{14}B$ phase in the obtained alloy was about 1,170° C. Therefore, the difference between the average removing temperature and the melting point was about 280° C.

In addition, the average cooling rate of the cast alloy on the cooling roller was 980° C./s, and the average thickness of the cast alloy was 0.29 mm.

The obtained cast alloy flakes were stored in the heat-retaining container 32 of the heat-retaining device 3 shown in FIG. 1, and the temperature was maintained at 800° C. for 30 seconds on average. In this way, the cast alloy flakes containing the rare-earth element were produced in Example 1.

Example 2

The cast alloy flakes of Example 2 were produced in a manner identical to that of Example 1, except that the cast alloy flakes were stored in the heat-retaining container 52 of the heat-retaining device 30 shown in FIG. 3, and the temperature was maintained at 800° C. for 2 minutes and 30 seconds on average.

Comparative Example 1

The cast alloy flakes of Comparative Example 1 were produced in a manner identical to that of Example 1, except that the heat-retaining treatment was not carried out.

Then, the cast alloy flakes in Examples 1 and 2, and Comparative Example 1 were finely pulverized such that the average particle diameter was 5 μm (measured by a laser diffraction meter), and compacted using the molding device in a transverse magnetic field in a 100% nitrogen atmosphere. The molding pressure was 0.8 t/cm$^2$, and the magnetic field in the cavity of the mold was set to 15 kOe.

The obtained mold was maintained at 500° C. for 1 hour under a vacuum of $1.33\times10^{-5}$ hPa, and subsequently this was maintained at 800° C. for 2 hours under a vacuum of $1.33\times10^{-5}$ hPa. After that, this was further maintained at 1030° C. for 2 hours under a vacuum of $1.33\times10^{-5}$ hPa. Thereby, the obtained compacts were sintered. The sintered density was 7.67-7.69 g/cm$^3$ or more, which is sufficient density.

In addition, the sintered body was heated at 530° C. for 1 hour in an argon atmosphere, and the R-T-B-based magnets in Examples 1 and 2 and Comparative Example 1 were obtained.

The magnetic properties of the obtained R-T-B-based magnets were measured by the pulse form BH curve tracer. The results are shown in FIG. 4.

Figure 4:
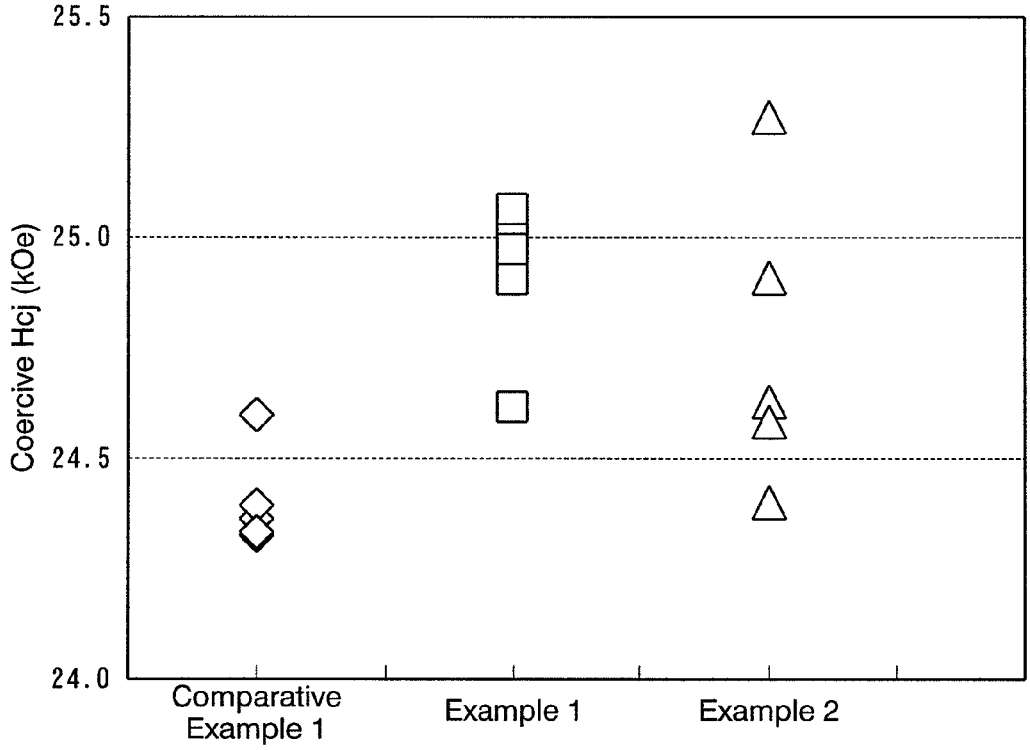
FIG. 4 is a graph showing the coercive force of the R-T-B-based alloy in Examples 1 and 2, and Comparative Example 1.

FIG. 4 is a graph showing the coercive force (Hcj) of the R-T-B-based magnets of Example 1, Example 2, and Comparative Example 1.

It is clear from FIG. 4 that the R-T-B-based magnets of Examples 1 and 2 in which the heat-retaining treatment was performed have a larger coercive force than that of the R-T-B-based magnet of Comparative Example 1 in which the heat-retaining treatment was not performed.

INDUSTRIAL APPLICABILITY

The production apparatus for an alloy according to the present invention can improve various properties of an alloy. In particular, when the alloy is the R-T-B-based alloy, the coercive force can be improved by retaining the temperature. Therefore, it is possible to produce a rare-earth element magnet having a high coercive force without increasing the compositional ratio of Dy and Tb in the R-T-B-based alloy.

The invention claimed is:

1. An apparatus for producing an alloy, wherein the device includes at least a casting device for casting a molten alloy by a strip casting method, a crushing device for crushing a cast alloy after casting, a heat-retaining device for maintaining the temperature of cast alloy flakes supplied from the crushing device, and a storage container for storing the cast alloy flakes after maintaining the temperature; and the heat-retaining device includes a heat-retaining container for storing the cast alloy flakes supplied from the crushing device, a heater for maintaining the temperature of the cast alloy flakes in the heat-retaining container, and an inclination device for inclining the heat-retaining container and sending the cast alloy flakes in the heat-retaining container to the storage container wherein the inclination device includes at least a pair of conveyor rollers, an endless conveyor belt which drives so as to rotate between a pair of the conveyor rollers, and a fixing member for fixing slidably the heat-retaining container on a conveyor surface of the endless conveyor belt; and the heat-retaining container is inclined when a moving direction of the endless conveyor belt is reversed by either conveyor roller of a pair of the conveyor rollers.

2. The apparatus for producing an alloy according to claim 1, wherein the inclination device sends the cast alloy flakes to the storage container after a specific period of heat-retaining time since the cast alloy flakes are stored in the heat-retaining container.

3. The apparatus for producing an alloy according to claim 1, wherein the heater is arranged on a wall and/or a bottom of the heat-retaining container.

4. The apparatus for producing an alloy according to claim 1, wherein the heater is arranged above the heat-retaining container.

5. The apparatus for producing an alloy according to claim 1, wherein the heater is arranged below the heat-retaining container.

6. The apparatus for producing an alloy according to claim 1, wherein a plurality of the heat-retaining containers is fixed to the endless conveyor belt.

7. The apparatus for producing an alloy according to claim 1, wherein the inclination device includes a rotation shaft provided to the heat-retaining container, and a movable device for inclining the heat-retaining container by inclining the rotation shaft.

8. The apparatus for producing an alloy according to claim 7, wherein the heat-retaining container has an inlet hole for the cast alloy flakes at the upper part, and an openable outlet portion for the cast alloy flakes at the side part.

9. The apparatus for producing an alloy according to claim 1, wherein the casting device, the crushing device, and the heat-retaining device are arranged inside of a chamber in an inert gas atmosphere.

10. The apparatus for producing an alloy according to claim 1, wherein the alloy is a rare-earth element containing alloy.

11. The apparatus for producing an alloy according to claim 10, wherein the rare-earth element containing alloy is an R-T-B-based alloy (wherein R is at least one element selected from the group consisting of rare-earth elements including Y, T is an alloy containing Fe as an essential component, and B is boron).

12. The apparatus for producing an alloy according to claim 1, wherein the alloy is a hydrogen storage alloy.

13. The apparatus for producing an alloy according to claim 1, wherein the alloy is a thermoelectric semiconductor alloy.

14. An apparatus for producing an alloy, wherein the device includes at least a casting device for casting a molten alloy by a strip casting method, a crushing device for crushing a cast alloy after casting, a heat-retaining device for maintaining the temperature of cast alloy flakes supplied from the crushing device, and a storage container for storing the cast alloy flakes after maintaining the temperature; and the heat-retaining device includes a heat-retaining container for storing the cast alloy flakes supplied from the crushing device, a heater for maintaining the temperature of the cast alloy flakes in the heat-retaining container, and an inclination device for inclining the heat-retaining container and sending the cast alloy flakes in the heat-retaining container to the storage container, wherein the inclination device includes a rotation shaft provided to the heat-retaining container, and a movable device for inclining the heat-retaining container by inclining the rotation shaft.

15. The apparatus for producing an alloy according to claim 14, wherein the heat-retaining container has an inlet hole for the cast alloy flakes at the upper part, and an openable outlet portion for the cast alloy flakes at the side part.

* * * * *